US011905704B2

(12) United States Patent
Moran et al.

(10) Patent No.: US 11,905,704 B2
(45) Date of Patent: Feb. 20, 2024

(54) MODULAR BUILDING

(71) Applicant: Woodlands Home & Garden Group Limited, Leeds (GB)

(72) Inventors: Ross Moran, Leeds (GB); Andrew Wrigglesworth, Leeds (GB); Lauren Coley, Leeds (GB)

(73) Assignee: Woodlands Home & Garden Group Limited, Leeds (GB)

( * ) Notice: Subject to any disclaimer, the term of this patent is extended or adjusted under 35 U.S.C. 154(b) by 90 days.

(21) Appl. No.: 17/526,570

(22) Filed: Nov. 15, 2021

(65) Prior Publication Data

US 2022/0195725 A1 Jun. 23, 2022

(30) Foreign Application Priority Data

Dec. 22, 2020 (GB) ..... 2020397

(51) Int. Cl.
*E04B 2/70* (2006.01)

(52) U.S. Cl.
CPC ..... *E04B 2/702* (2013.01)

(58) Field of Classification Search
CPC . E04B 2/70; E04B 2/701; E04B 2/702; E04B 2/703; E04B 2/704; E04B 2/705; E04B 2/706; E04B 2/707; E04B 2/709; E01D 19/06; E01D 19/062; E01D 19/065; E04F 15/14; E04F 15/1472
USPC ..... 52/36.5, 233
See application file for complete search history.

(56) References Cited

U.S. PATENT DOCUMENTS 1,510,326 A * 9/1924 Locke ..... A63H 33/044 52/92.1
2,110,787 A * 3/1938 Brandjord ..... E04B 2/708 D25/113
8,171,688 B2 * 5/2012 Junker ..... E04C 2/12 52/564
10,563,398 B1 * 2/2020 Kreizinger ..... E04B 1/10
(Continued)

FOREIGN PATENT DOCUMENTS

CN 201362889 Y 12/2009
DE 4306574 A1 9/1994
(Continued)

OTHER PUBLICATIONS

The Extended European Search Report, Application No. 21207290.4, dated Apr. 11, 2022.
(Continued)

*Primary Examiner* — William V Gilbert
(74) *Attorney, Agent, or Firm* — MacMillan, Sobanski & Todd, LLC

(57) ABSTRACT

A modular building includes at least one outer wall that includes at least first and second panels aligned end to end at a panel joint. Each panel includes first planks forming a part of the outer wall of the building and second planks forming a first decorative wall fixed to the outer wall. The decorative wall extends substantially perpendicular to the outer wall and terminates beyond the first planks on at least one side of the panel. The space between the first decorative wall of the panel and an adjacent decorative wall of a second panel accommodates a shelving unit or a joint cover strip that covers the panel joint.

16 Claims, 5 Drawing Sheets

(56) References Cited

U.S. PATENT DOCUMENTS

| | | | | |
|---|---|---|---|---|
| 2003/0200710 | A1* | 10/2003 | Gil | E04B 1/30 52/309.15 |
| 2018/0112397 | A1* | 4/2018 | Bertrand | E04C 2/296 |
| 2018/0209144 | A1* | 7/2018 | Hedgcock | E04C 2/043 |
| 2018/0223527 | A1* | 8/2018 | Marcio | E04B 1/18 |

FOREIGN PATENT DOCUMENTS

| | | | |
|---|---|---|---|
| KR | 20110034983 | A | 4/2011 |
| WO | 9518330 | A1 | 7/1995 |
| WO | 2012004633 | A1 | 1/2012 |

OTHER PUBLICATIONS

Intellectual Property Office Patents Act 1977: Search Report under Section 17(5), Application No. GB2020397.2, dated Jun. 10, 2021.

* cited by examiner

MODULAR BUILDING

BACKGROUND OF THE INVENTION

The present disclosure relates to modular buildings and particularly, but not exclusively, relates to modular log cabins that can be transported on a pallet and assembled from panels of a standard size using a novel jointing system.

Conventional modular buildings, such as log cabins, can be supplied as a kit comprising logs or planks of varying length, which must be transported loose or as a flat pack on a lorry with other components, such as windows doors and roof members. Different size log cabins result in different size loads to be accommodated on the lorry or other transport vehicle. This presents logistical difficulties in putting multiple log cabin kits on a single vehicle and requires an extensive inventory to be maintained by the manufacturer.

SUMMARY OF THE INVENTION

According to an aspect of the disclosure, there is provided a modular building, wherein at least one outer wall of the building includes at least first and second panels aligned in the same plane and meeting end to end at a panel joint. The first panel includes first planks forming a part of the outer wall of the building and second planks forming a first wall fixed to the outer wall and spaced from the other panel. The first wall extends substantially perpendicular to the outer wall and terminates beyond the first planks on at least one side of the panel. A space between the first wall of the first panel and a second wall of the second panel accommodates a joint cover strip that covers the panel joint.

According to another aspect of the disclosure, there is provided a modular building, at least one outer wall of the modular building including:

- at least first and second panels substantially aligned in the same plane and meeting end to end at a panel joint;
- a first wall fixed to the first panel and projecting from it, the first wall being spaced from the second panel;
- a second wall fixed to the second panel and projecting from it, the second wall being spaced from the first panel; and
- shelving fixed between the first and second walls.

The shelving may be adapted to provide structural support to the modular building. For example, the thickness and/or stiffness of the shelving may be selected so that it can provide structural support to the first and second panels and/or to a roof of the building.

The walls fixed to the first and second panels may include decorative or faux walls or partitions. These walls may extend for less than 10% of the width of the building and may, for example, extend no more than 400 mm from the panel to which they are fixed. The shelving may extend for the full length of the walls or may be set back from a free end of at least one wall. The walls may be formed from boards or planks. The walls may be of the same length.

The modular building may be a log cabin, and the planks may be actual logs, split logs, or planks and/or boards profiled to resemble logs or split logs.

Two joint cover strips may be provided to cover the panel joint on both sides of the panels. One or both of the joint cover strips may be fixed to the panels with releasable or permanent fixings, such as screws bolts staples or adhesive.

Shelving may be provided in the space between the first decorative wall of the first panel and the second decorative wall of the second panel. The shelving may be configured to brace the first decorative wall of the first panel and the second decorative wall of the second panel, thereby providing structural support to the log cabin.

The shelving may include a single shelf or a plurality of shelves. The shelving may also include a back board to which the shelves are fixed. The back board may take the place of the cover strip and perform the same function.

The shelving may be fixed to the first and second decorative walls, for example, by fixings that are inserted through the first and second decorative walls into the shelving.

The first planks may be interlocked one with another. The second planks may also be interlocked one with another. For example, the first and/or second planks may be interlocked by means of a tongued and grooved connection.

The first and second planks may be of the same width and height, but of different length. Each panel may be no more than 6 feet (1.83 meters) wide so that the planks that make up the panels can be transported upright on a standard shipping pallet.

According to another aspect of the disclosure, there is provided a method of assembling a modular building including the steps of: forming at least one outer wall of the modular building by assembling at least first and second panels so that they abut end to end at a panel joint, each panel including first planks forming a part of the outer wall of the log cabin and second planks forming a decorative wall fixed to the outer wall and spaced from the other panel, the decorative walls extending substantially perpendicular to the outer wall and terminating beyond the first planks on at least one side of each panel; and fixing a joint cover strip over the panel joint between the first decorative wall of the first panel and the second decorative wall of the second panel.

The method may further include the step of fixing shelving in the space between the first decorative wall of the first panel and the second decorative wall of the second panel. The shelving may be configured to brace the first decorative wall of the first panel relative to the second decorative wall of the second panel, and thereby provide structural support to the modular building. For example, the shelving may be made of material that is thick enough not to flex under the design environmental loading, such as wind loading, that may be applied to the building in use.

According to another aspect of the disclosure, there is provided a modular building, at least one outer wall of the modular building including:

- at least first and second panels substantially aligned in the same plane and meeting end to end at a panel joint;
- a first wall fixed to the first panel and projecting from it, the first wall being spaced from the second panel;
- a second wall fixed to the second panel and projecting from it, the second wall being spaced from the first panel; and
- a space between the first wall of the first panel and a second wall of the second panel accommodating a joint cover strip that covers the panel joint.

According to another aspect of the disclosure, there is provided a modular building, wherein the walls of the modular building include interchangeable panels all of the same width and height, the panels selected from at least two of a plain panel, a window panel, and a door panel.

According to another aspect of the disclosure, there is provided a kit of parts for forming a modular building as set out above. The kit may include first planks and second planks, all of which are no longer than 6 feet (1.83 meters).

Advantages provided by one or more aspects of the disclosure are:

1) the decorative or "faux" walls/partitions can be used to hide a joint cover strip or to support shelving inside the building;
2) the shelving fixed between the decorative or "faux" walls/partitions provides structural stiffness to the building;
3) the building is fully modular, which means the doors and windows can be moved around to the front, rear, or side/gable end;
4) a unique jointing system, whereby panels are jointed together using internal and external joint cover strips that is quick and gives an excellent finish;
5) the modular nature of the building, with planks/boards no longer than 6 feet (1.83 meters), gable tops in two pieces, reduced overall height of the finished building, and roof and floor supplied board by board, allows for the building to be packed onto standard shipping pallets and distributed through a pallet network on a next day delivery service. Consequently, specialized transporters are not required for distribution, so shipping costs are lower, and the reach is more universal, making a log cabin more attainable for more customers;
6) the modular nature of the design also means components are smaller, more portable, and easier to handle and assemble, resulting in reduced risk of injury to those transporting the buildings and those carrying out the assembly, and less risk of damage to the components of the building during transport and assembly; and
7) during packaging, the product can be assembled in bundled sections, with the planks/boards stood on end and fastened to the pallet in a quick and easy manner.

To avoid unnecessary duplication of effort and repetition of text in the specification, certain features are described in relation to only one or several aspects or embodiments of the invention. However, it is to be understood that, where it is technically possible, features described in relation to any aspect or embodiment of the invention may also be used with any other aspect or embodiment of the invention.

DETAILED DESCRIPTION OF THE PREFERRED EMBODIMENT

Figure 1:
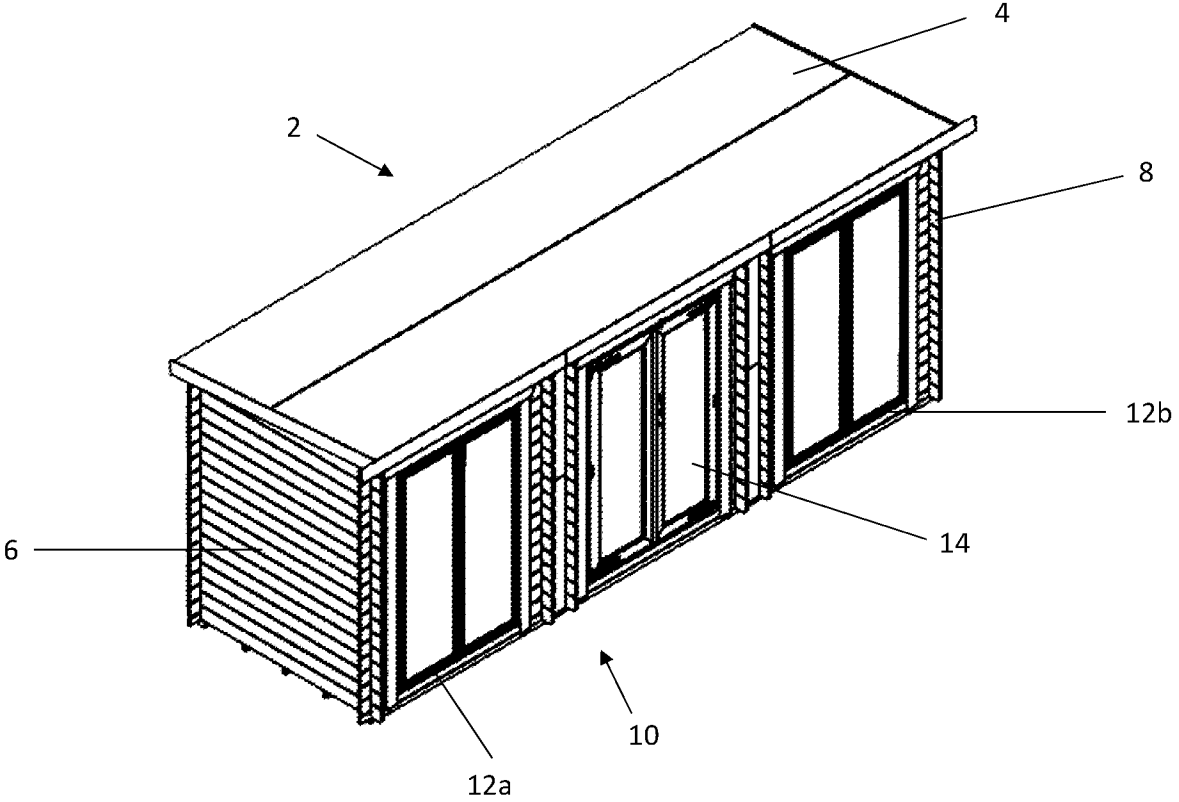
FIG. 1 is a perspective view of a modular building.
Figure 2:
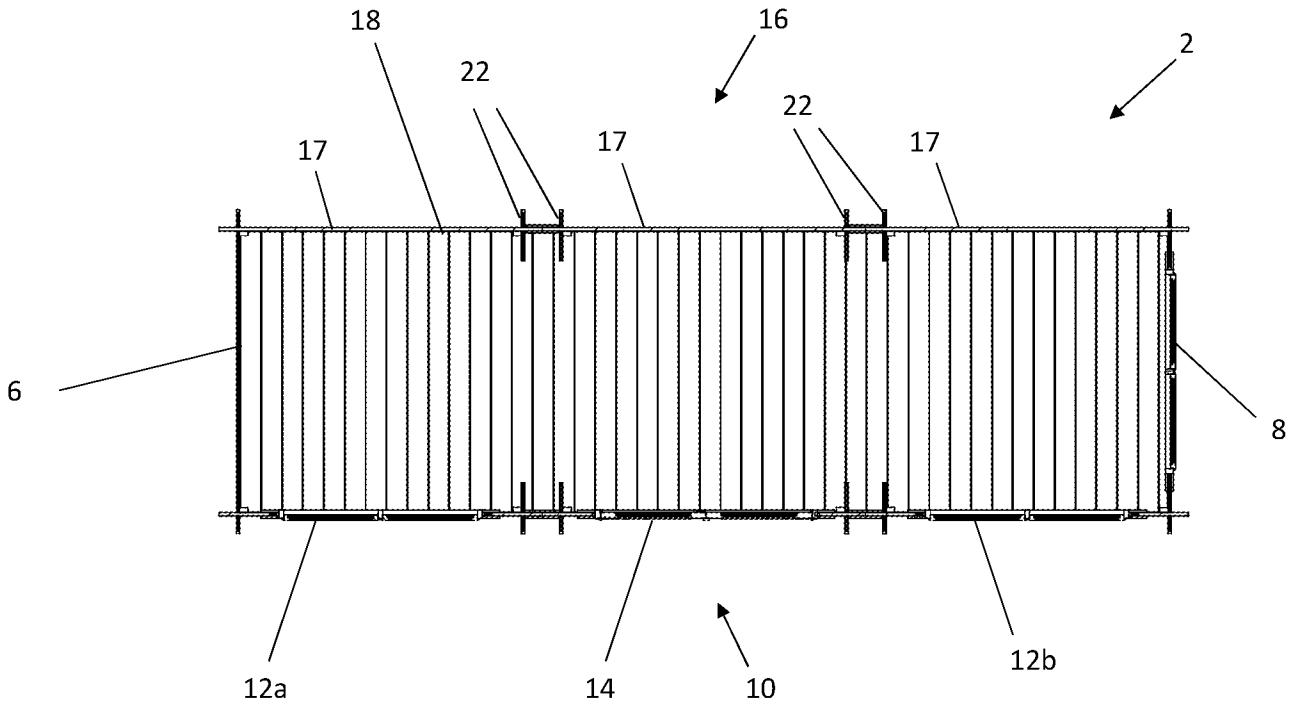
FIG. 2 is a plan view of the modular building with the roof removed.

FIGS. 1 and 2 illustrate a modular building 2 in the form of a log cabin. The modular building is of conventional layout, with a pent roof 4, side walls 6 and 8, a front wall 10 including two full height windows 12*a* and 12*b* and French doors 14, and a rear wall 16. The windows 12*a* and 12*b* and/or French doors 14 may be provided in a pre-fabricated form. For example, they may be ready fitted into a frame so that they can be fitted quickly into place as the building 2 is assembled.

The building is modular in the sense that the side walls 6, 8, the front wall 10, and the back wall 16 are made up of panels 17 of a pre-set width. For example, each panel 17 may be 6 feet (1.83 meters) wide. As the front wall 10, side walls 6, 8, and back wall 16 are made up of panels 17, the length of these walls 6, 8, 10, 16 can be increased simply by adding additional panels 17. Also, plain panels 17 can be replaced by a variety of different door panels or window panels so that the size and layout of the modular building 2 can be changed easily, and the inventory that needs to be kept in the warehouse is minimized.

The panels 17 forming the walls 6, 8, 10, 16 are at least partly made up from individual planks 18 that may be slotted together, for example, using a tongue and groove arrangement. In the illustrated embodiment, these planks 18 are profiled and shaped to look like split logs so that the overall effect of the modular building is that of a log cabin construction. The use of contoured planks that look like split logs gives the building a distinctive and attractive overall appearance. It should, however, be appreciated that the principles of this invention could be applied to any other form of modular building made up from panels. Thus, for example, the panels 17 may include flat-faced or differently contoured or tapered planks.

Figure 3A:
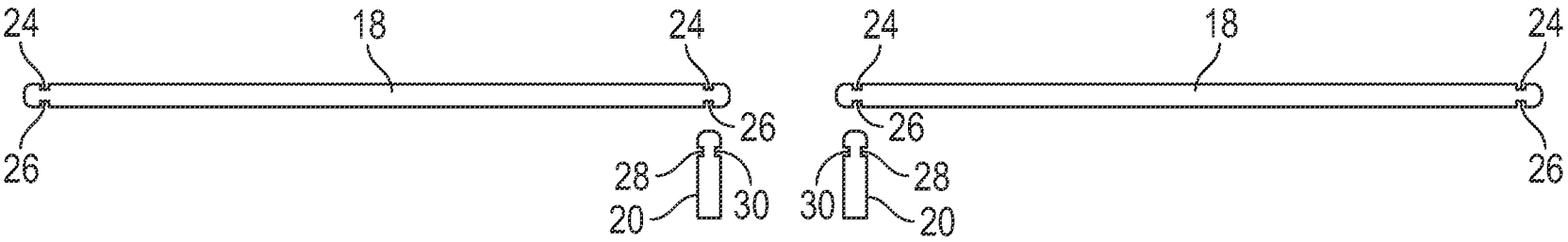
FIG. 3A is a side elevational view that shows two first planks and two second planks that can be assembled for making up two rear panels of the modular building.
Figure 3B:
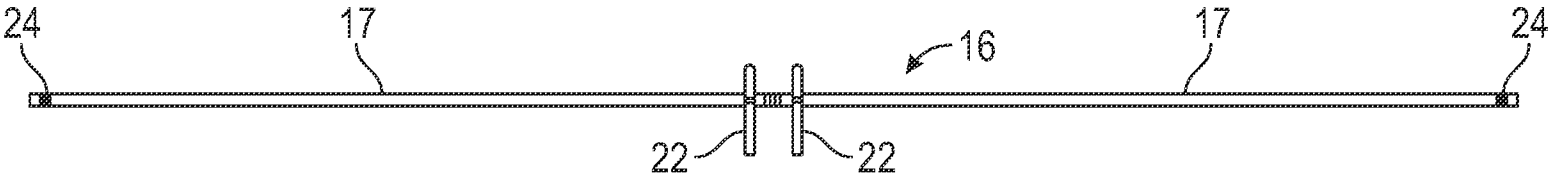
FIG. 3B is a plan view that shows the two assembled rear panels aligned with and abutting one another, and that shows a gap between the two second planks of the two rear panels.

Referring to FIG. 3A, at least the panels 17 forming the rear wall 16 are made up of two sizes of plank. The main part of each panel 17 is made up of first planks 18 that extend for the full width of the panel 17 and extend in a substantially horizontal direction in the plane of the rear wall 16. Referring to FIG. 3B, toward at least one edge of each panel 17, second planks 20 engage at right angles with the first planks 18 to form decorative walls 22 on the inside and outside of the modular building 2. In order for the second planks 20 to slot into and engage with the first planks 18, slots 24, 26 are formed in the sides of the second planks 20, which slots 24, 26 extend substantially parallel to a longitudinal axis of the second planks 20, and slots 28, 30 are formed in the sides of the first planks 18, which slots 28, 30 extend substantially parallel to a longitudinal axis of the first planks 18.

In order to assemble a panel 17, a first plank 18 is laid on a foundation (not shown) of the modular building 2. The foundation may, for example, include a concrete slab foundation. The plank 18 is laid on its long edge, and then a second plank 20 is laid on edge across the first plank 18 so that the first and second planks 18 and 20 are substantially perpendicular, and further so that the lower slot 28 of the second plank 20 engages in the upper slot 24 of the first plank 18. As these slots 24, 28 extend for a quarter of the width of the respective plank, and the first planks 18 and second planks 20 are of the same width, the second plank 20 will be suspended above the foundation by half the width of a first plank 18. Then, the next first plank 18 is slotted into place onto the upper edge of the first plank 18 so that the dovetail groove formed in the lower edge of the upper first plank 18 engages onto the dovetail rib of the lower first plank 18. As the upper first plank 18 is installed, the lower slot 26 in the upper first plank engages into the upper slot 30 in the second plank 20. The next second plank 20 is then laid on edge across the upper first plank 18 so that the first and second planks 18, 20 are substantially perpendicular, and further so that the lower slot 28 of the upper second plank 20 engages in the upper slot 24 of the upper first plank 18.

This alternate laying of first and second planks 18, 20 across one another is continued until the panel 17 reaches its full design height, resulting in a panel 17 including a continuous wall of long first planks 18 interconnected with a decorative wall 22 of shorter planks 20.

This same engagement of first and second planks 18, 20 may take place simultaneously at both ends of the panel so that the finished panel 17 has decorative walls 22 at both ends, as best shown in FIG. 2.

Figure 3C:
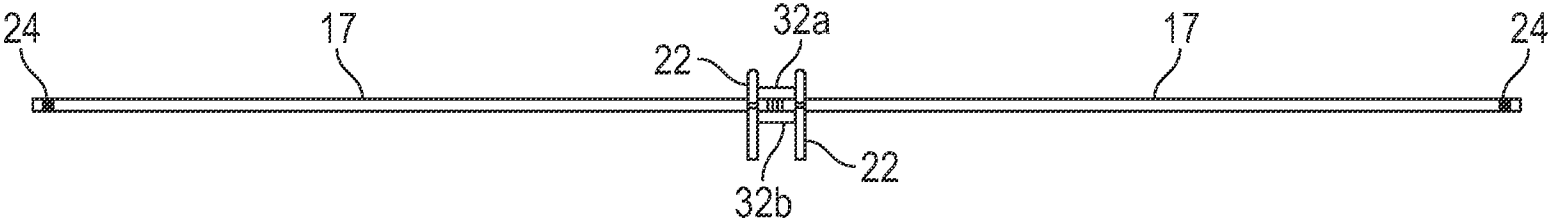
FIG. 3C is a plan view that shows how the gap between the two second planks of the two rear panels is covered by inner and outer cover strips.

As best shown in FIG. 3C, in order to form the rear wall 16 of the modular building 2, panels 17 are erected edge to edge and are connected together by cover strips 32*a*, 32*b*, which cover the gap between successive panels. The cover strips 32*a*, 32*b* may be fixed in any desired manner, such as by being glued, screwed, stapled, or bolted to the panels 17. It will be appreciated that as the cover strips 32*a*, 32*b* are situated between respective pairs of decorative walls 22, they are at least partially hidden, thereby improving the appearance of the inside of the modular building 2. In addition, the decorative walls 22 may project from the outside face of the rear wall 16, again presenting an attractive feature. Consequently, the decorative walls 22 are both functional and attractive. Firstly, they interconnect the first planks 18 and hold the panels 17 together and provide rigidity to the panels 17 and rear wall 16. Secondly, they provide a striking visual feature that further enhances the appearance of the modular building.

Figure 4:
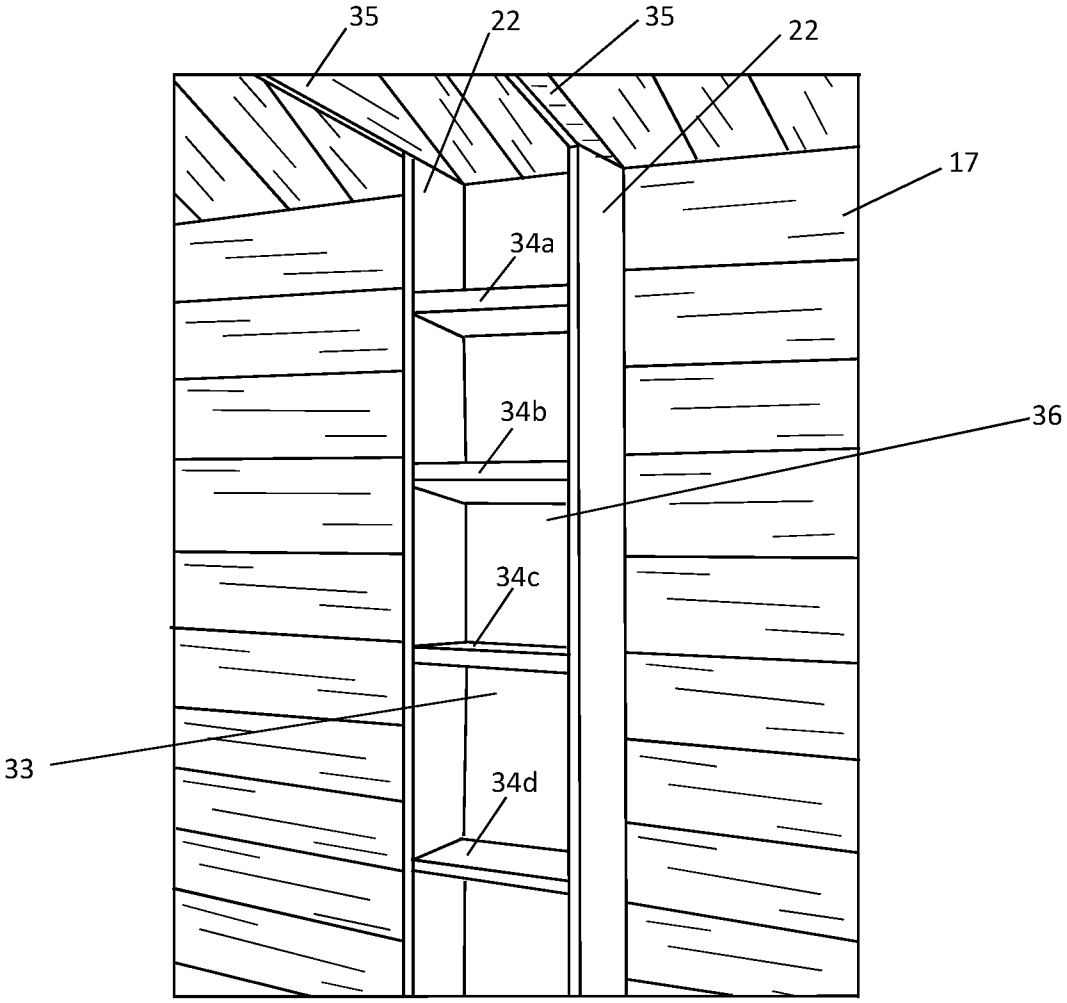
FIG. 4 is a perspective view that shows shelving fixed between adjacent decorative wall portions of the two second blanks inside the modular building.

FIG. 4 shows how shelving may be fixed into the gap 33 formed between adjacent decorative walls 22. In the illustrated embodiment, the shelving includes a plurality of shelves 34*a*, 34*b*, 34*c*, 34*d* that are fixed into the gap 33 between adjacent decorative walls 22 by means of screws, which pass through holes formed in the decorative walls 22 and are screwed into the edges of respective shelves 34*a*, 34*b*, 34*c*, 34*d*. The shelves 34*a*, 34*b*, 34*c*, 34*d* are also fixed to a back board 36 in any desired manner, such as by being glued, screwed, stapled or bolted to the back board 36. The back board 36 may be fixed to the cover strip 32*a*, 32*b* or may take the place of the cover strip 32*a*, 32*b*. For example, the shelving may include a preassembled shelving unit so that the shelves 34*a*, 34*b*, 34*c*, 34*d* are fixed to the back board 36 and are used to connect adjacent panels 17 in place of a cover strip 32*a* or 32*b*. In alternative embodiments, the shelves 34*a*, 34*b*, 34*c*, 34*d* may be fixed only to the decorative panels 22 or to the decorative panels 22 and to the cover strip 32*a*, 32*b*. Any number shape of size of shelves and any structure or orientation of shelving is contemplated for use in this invention.

In addition to serving as conventional shelving within the modular building 2, the shelving serves the additional purpose of providing stiffness and structural strength to the modular building. More particularly, the shelving acts with the decorative walls 22 to form a pillar structure within the building, which provides rigidity and additional support to the rear wall 16 and roof 4 via roof trusses 35.

It will be appreciated that the lowermost second planks 20 of each decorative wall 22 will be suspended above the floor by half the width of a first plank 18 because the bottom of the lower slot 28 in the lowermost second plank 20 abuts the bottom of the upper slot 24 of the lowermost first plank 18 when the bottom edge of the second plank 20 is aligned with the center of the first plank 18. This gives the decorative walls 22 and integrated shelving an attractive "floating" appearance because the decorative walls 22 are supported indirectly off the panel 17, rather than directly off the floor or foundation of the modular building 2. Where a continuous decorative wall 22 is preferred, a half width second plank (not shown) may be slotted onto the bottom of each decorative wall 22.

Figure 5:
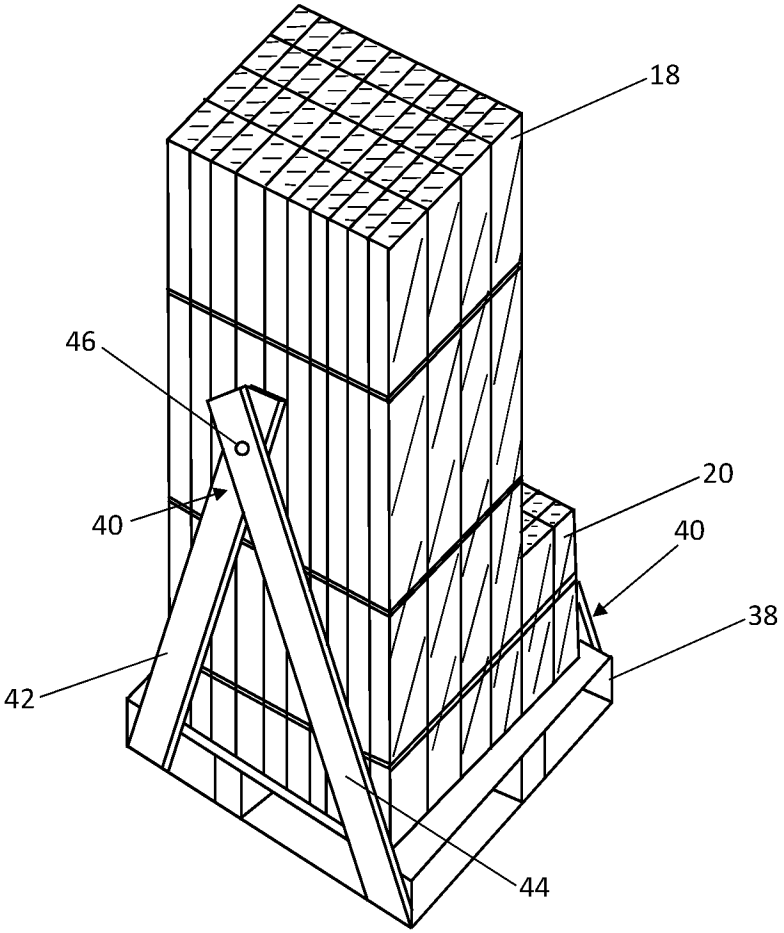
FIG. 5 is a perspective view that shows the modular building stacked onto a standard shipping pallet.

As mentioned above, the planks that make up the modular building are of a pre-determined maximum length. For example, they may be no larger than 6 feet (1.83 meters) in length. This means that the planks 18, 20 can be assembled upright on a standard shipping pallet 38 as illustrated in FIG. 5. In order to support the planks 18, 20, an A-frame 40 is constructed on either end of the pallet 38. Each A-frame is formed from two members, such as boards 42, 44 extending diagonally from respective corners of the pallet 38. The boards 42, 44 are fixed to the corners of the pallet 38 and are joined together where they cross by fixings such as screws or bolts (not shown). A horizontal member, such as a rod or plank 46, interconnects the A-frames and is fixed at the points at which the boards 42, 44 cross. The horizontal member 46 provides a support against which the planks 18, 20 can be laid and fixed. To further aid in the transport of a kit for a modular building 2, the trusses or gable tops that support the roof may be provided in two pieces for assembly on site.

A whole kit for forming a small modular building 2 may be loaded onto a single pallet 38 or, for a larger building, multiple pallets 38 may be required. As the kit mounted on the pallet 38 does not extend beyond the horizontal extent of the pallet 38, and as the height of the longest component mounted vertically on the pallet 38 does not exceed the maximum load height permitted by the hauler (for example, 6 feet (1.83 meters)), the pallet 38 can be transported just like any other pallet load. As a result, loading, unloading and shipping of the modular building 2 described above is easier quicker and less expensive than for conventional modular buildings.

Because of the modular construction of the building and the interchangeability of panels mentioned above, the building is also highly configurable. The modularity and interchangeability extends to all parts of the building. For example, the window panels can be replaced, and also panels on the front, rear, or the gable ends, by selecting panels of matching dimensions. Consequently, a purchaser of the building could, for example, opt to have more window sections and fewer blank panels, or could chose a different roof design, such as a flat roof or pitched roof. The product is also adaptable enough to be confide at final fitting stage, rather than any bespoke tailoring having to take place prior to manufacturing. Also, at some time after construction, the purchaser could choose to modify or extend the building just by purchasing additional wall panels, roof panels, windows, and/or doors.

It will be appreciated by those skilled in the art that although the invention has been described by way of example with reference to one or more exemplary examples, it is not limited to the disclosed examples, and that alternative examples could be constructed without departing from the scope of the invention as defined by the appended claims.

What is claimed is:

1. A modular building, at least one outer wall of the modular building comprising:

a pair of panels aligned substantially in the same plane and meeting end to end at a panel joint;

each of the pair of panels including a first plank forming a part of the outer wall of the modular building and a second plank fixed to the first plank and including a decorative wall portion;

the decorative wall portions of the second planks extending substantially perpendicular to the first planks and defining a space therebetween; and a joint cover strip which extends between the decorative wall portions and covers the panel joint.

2. A modular building as claimed in claim 1, wherein the first and second planks are actual logs, split logs, or planks profiled to resemble actual logs or split logs.

3. A modular building as claimed in claim 1, wherein the joint cover strip is a first joint cover strip, and further including a second joint cover strip which extends between the decorative wall portions and also covers.

4. A modular building as claimed in claim 1, wherein shelving is provided in the space defined between the first decorative wall portions of the second planks.

5. A modular building as claimed in claim 4, wherein the shelving is configured to brace the decorative wall portions of the second planks.

6. A modular building as claimed in claim 4, wherein the shelving comprises a plurality of shelves.

7. A modular building as claimed in claim 4, wherein the shelving is fixed to the decorative wall portions of the second planks.

8. A modular building as claimed in claim 4, wherein the shelving is fixed to the decorative wall portions of the second planks by releasable fixings.

9. A modular building as claimed in claim 1, wherein the first planks are interlocked one with another by the joint cover strip.

10. A modular building as claimed in claim 1, wherein the second planks are interlocked together by the joint cover strip.

11. A modular building as claimed in claim 9, wherein each of the first planks is interlocked together with a respective one of the second planks by a tongued and grooved connection.

12. A modular building as claimed in claim 1, wherein the first and second planks are of the same width.

13. A modular building as claimed in claim 12, wherein each of the pair of panels is no more than 6 feet (1.83 meters) wide.

14. A modular building, at least one outer wall of the modular building comprising:

a pair of panels aligned substantially in the same plane and meeting end to end at a panel joint;

each of the pair of panels including a first plank forming a part of the outer wall of the modular building and a second plank fixed to the first plank and including a decorative wall portion;

the decorative wall portions of the second planks extending substantially perpendicular to the first planks; and shelving fixed between the decorative wall portions.

15. A method of assembling a modular building, the method comprising the steps of:

forming at least one outer wall of the modular building by assembling a pair of panels so that they abut end to end at a panel joint, each of the pair of panels including a first plank forming a part of the outer wall of the modular building and a second plank fixed to the first plank and including a decorative wall portion, the decorative wall portions extending substantially perpendicular to the first planks and defining a space therebetween, and fixing a joint cover strip over the panel joint between the decorative wall portions of the second planks.

16. A method of assembling a modular building as claimed in claim 15, further comprising the step of fixing shelving in the space defined between the decorative wall portions of the second planks.

* * * * *